US006511114B1

(12) United States Patent
Fludd

(10) Patent No.: US 6,511,114 B1
(45) Date of Patent: Jan. 28, 2003

(54) HANDLE FOR CARRYING PLASTIC BAGS

(76) Inventor: Harold J. Fludd, 505 Central Ave., White Plains, NY (US) 10606

( * ) Notice: Subject to any disclaimer, the term of this patent is extended or adjusted under 35 U.S.C. 154(b) by 0 days.

(21) Appl. No.: 10/032,432

(22) Filed: Dec. 31, 2001

Related U.S. Application Data

(60) Provisional application No. 60/262,344, filed on Jan. 19, 2001.

(51) Int. Cl.[7] ..... B65D 33/06

(52) U.S. Cl. ..... 294/159; 294/170

(58) Field of Search ..... 294/26, 137, 143, 294/158, 159, 170; 383/13, 23, 25; D8/300; D9/434, 455

(56) References Cited

U.S. PATENT DOCUMENTS 2,522,833 A * 9/1950 Maccaferri ..... 294/170 X
D314,150 S * 1/1991 Preciutti ..... 294/137 X
D340,863 S * 11/1993 Daigle ..... 294/159 X
5,361,956 A * 11/1994 Recanati ..... 294/159 X
5,487,581 A * 1/1996 Carmo et al. ..... 294/159 X
5,507,544 A * 4/1996 McQuade et al. ..... 294/159
5,599,052 A * 2/1997 Van Davelaar ..... 294/159

FOREIGN PATENT DOCUMENTS

SE 153190 * 1/1956 ..... 294/170

* cited by examiner

*Primary Examiner*—Johnny D. Cherry
(74) *Attorney, Agent, or Firm*—Robert J. Bird

(57) ABSTRACT

A handle for carrying plastic bags includes a flat plate with a top horizontal hand grip, a vertical member depending from each end of the hand grip, and a horizontal bottom portion, all surrounding a hand grip aperture. A number of bag hooks depend from the bottom portion, the outermost hooks being directed inward toward each other to prevent snagging. The outer periphery of the plate includes an outer flange, and the inner periphery of the hand grip aperture includes an inner flange.

2 Claims, 1 Drawing Sheet

HANDLE FOR CARRYING PLASTIC BAGS

CROSS-REFERENCE TO RELATED APPLICATION

This application relates to copending Provisional Applicaton No. 60/262,344, filed Jan. 19, 2001. That filing date is claimed for this application.

BACKGROUND OF THE INVENTION

This invention is a handle by which to carry a number of plastic bags, such as grocery bags.

Plastic bags made of thin plastic film are now in common use at checkout counters in supermarkets, drugstores, and the like. The thinness of the bag material can make it uncomfortable to carry, especially if it contains a relatively heavy load. Also, when more than one such bag is carried, the floppy handles tend to get tangled and confused.

This invention provides a handle from which to hang a number of plastic bags by their handles. Attachment/removal of bags is simple and easy, bag handles do not become tangled, and the handle fits comfortably in the hand.

SUMMARY OF THE INVENTION

In summary, this invention is a handle for carrying plastic bags. It includes a flat plate with a top horizontal hand grip, a vertical member depending from each end of the hand grip, and a horizontal bottom portion, all surrounding a hand grip aperture. A number of bag hooks depend from the bottom portion, the outermost hooks being directed inward toward each other to prevent snagging. The outer periphery of the plate includes an outer flange, and the inner periphery of the hand grip aperture includes an inner flange.

BRIEF DESCRIPTION OF DRAWINGS

In the accompanying drawings.

DETAILED DESCRIPTION

Figure 2:
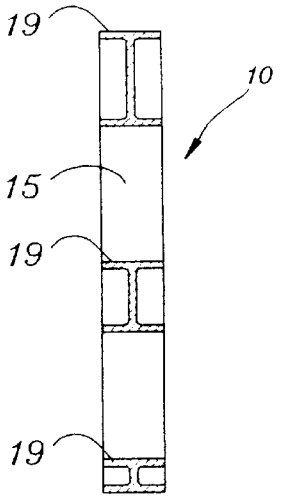
FIG. 2 is a sectional view on the plane 2—2 of FIG. 1.
Figure 1:
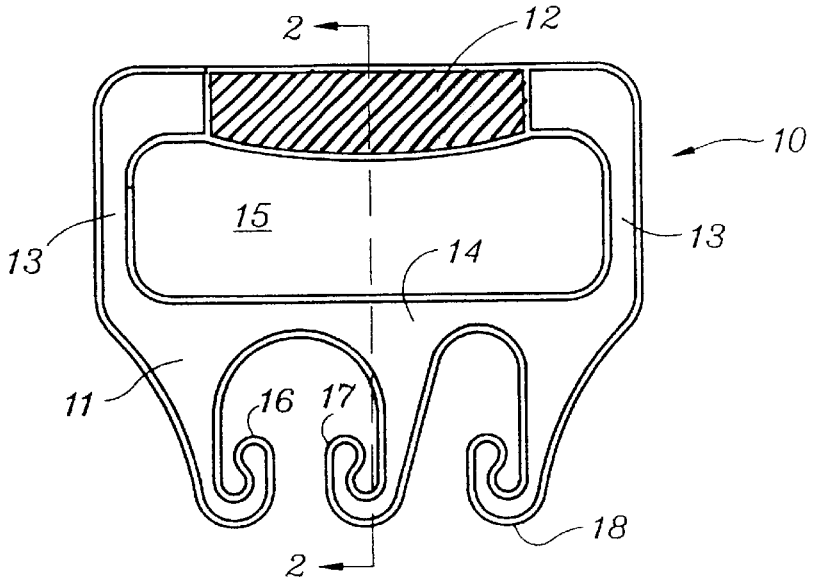
FIG. 1 is a front view of the bag handle of this invention.
Figure 3:
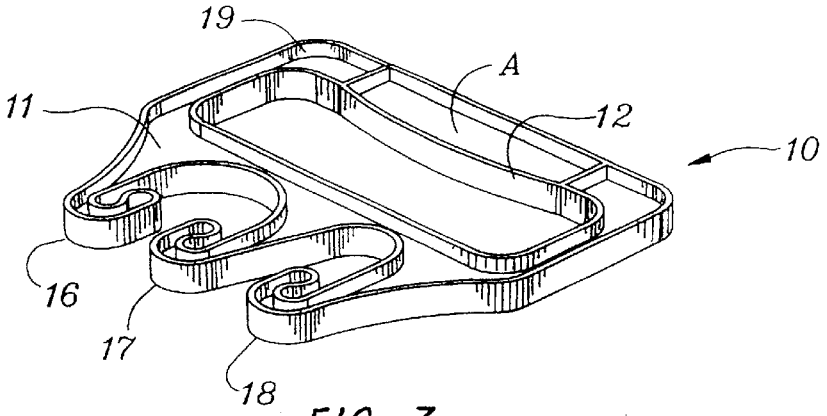
FIG. 3 is a three-dimensional pictorial view of the bag handle of FIG. 1.
Figure 4:
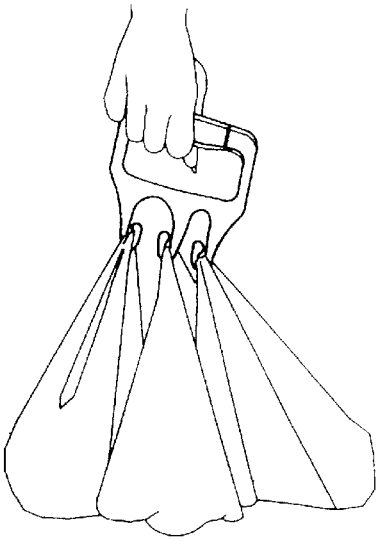
FIG. 4 illustrates the use of the bag handle.

With reference to the drawing, my bag handle 10 is a single piece of molded plastic. It includes a planar plate 11, with a horizontal hand grip 12 along the top, a vertical member 13 depending from each end of the hand grip 12, and a horizontal bottom member 14. The hand grip 12, vertical members 13, and bottom member 14 surround a hand grip aperture 15 under the hand grip 12. The bottom member 14 includes bag hooks 16, 17, 18 depending from the bottom thereof. There are three bag hooks in the example shown. The end hooks 16, 18 are hooked (or directed) inward to prevent them from snagging on extraneous things when the device is in use and being carried by the user. The bag handle 10, as best shown in cross section in FIG. 2, includes transverse flanges 19, giving the bag handle 10 the cross-section of an I-beam. This configuration gives the device load-carrying strength and also makes the hand grip comfortable. The horizontal hand grip 12 provides a plane area A for a bar code, logo, or the like.

The bag handle 10 is itself adapted to be hung on wall hooks in the kitchen, or in a car (on hooks in the back seat area ordinarily used for clothes hangers and the like).

Terms indicative of orientation are used with reference to drawing illustrations. Such terms are intended to facilitate description and understanding, and are not intended as limitations. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A handle for carrying plastic bags and the like, said handle including:

a flat plate having a horizontal hand grip, a vertical member on each end of said hand grip, and a horizontal bottom member connected to said vertical members, said hand grip, said vertical members, and said bottom member together defining a hand aperture;

first, second, and third bag hooks depending from said bottom member in a row, said first and third hooks being on opposite ends of said row and directed inward toward each other;

an inner flange extending in opposite directions normal to said plate around the periphery of said hand aperture; and an outer flange extending in opposite directions normal to said plate around the outer periphery of said plate and said hooks.

2. A handle for carrying plastic bags and the like, said handle including:

a vertical plate having a top horizontal hand grip, a vertical member depending from each end of said hand grip, and a horizontal bottom member;

said hand grip, said vertical members, and said bottom member together defining a hand aperture below said hand grip;

first, second, and third bag hooks depending from said bottom member in a row, said first and third hooks being on opposite ends of said row and directed inward toward each other;

an inner flange extending In opposite directions normal to said plate around the periphery of said hand aperture; and an outer flange extending in opposite directions normal to said plate around the outer periphery of said plate and said hooks.

* * * * *